United States Patent [19]

McCoy

[11] Patent Number: 4,615,817

[45] Date of Patent: Oct. 7, 1986

[54] ADDITIVES CONTAINING POLYTETRAFLUOROETHYLENE FOR MAKING STABLE LUBRICANTS

[76] Inventor: Frederic C. McCoy, 12 Regimental Pl., New Windsor, N.Y. 12550

[21] Appl. No.: 735,390

[22] Filed: May 17, 1985

[51] Int. Cl.[4] ..... C10M 131/08; C10M 149/00

[52] U.S. Cl. ..... 252/16; 252/51.5 R; 252/52 R; 252/50; 252/56 R

[58] Field of Search ..... 252/58, 16, 34, 51.5 R, 252/52 R, 56 R, 50

[56] References Cited

U.S. PATENT DOCUMENTS

| | | | |
|---|---|---|---|
| 2,510,078 | 6/1950 | Compton | 252/58 |
| 2,510,112 | 6/1950 | Holbrook | 252/58 |
| 3,194,762 | 7/1965 | Browning et al. | 252/58 |
| 3,234,758 | 2/1966 | Lewis | 252/58 |
| 3,630,901 | 12/1971 | Messina et al. | 252/58 |
| 3,640,859 | 2/1972 | Messina et al. | 252/58 |
| 3,723,317 | 3/1973 | Wery | 252/58 |
| 3,879,302 | 4/1975 | Reick | 252/58 |
| 3,933,656 | 1/1976 | Reick | 252/25 |
| 4,284,519 | 8/1981 | Reick | 252/16 |
| 4,349,444 | 9/1982 | Reick | 252/58 |
| 4,472,290 | 9/1984 | Capericcio et al. | 252/58 |
| 4,525,286 | 6/1985 | Reick | 252/58 |

*Primary Examiner*—William R. Dixon, Jr.
*Assistant Examiner*—Cynthia A. Prezlock
*Attorney, Agent, or Firm*—Brooks Haidt Haffner & Delahunty

[57] ABSTRACT

A lubricating oil additive comprising a stable dispersion of finely divided polytetrafluoroethylene particles having a relatively high molecular weight, a polymeric, oil-soluble dispersant containing nitrogen, an organoclay anti-sedimentation agent and a polar activator therefor in a lubricating oil, the additives being free of polytetrafluoroethylene sedimentation, together with lubricating oils containing such additives and processes for producing the additives.

23 Claims, No Drawings

ADDITIVES CONTAINING POLYTETRAFLUOROETHYLENE FOR MAKING STABLE LUBRICANTS

FIELD OF THE INVENTION

The present invention relates to lubricating oil additives providing superior anti-friction properties to lubricating oils, and more particularly, it relates to polytetrafluoroethylene-containing oil dispersions utilizing a polymeric dispersant containing nitrogen, an organo-clay and a polar additive, together with methods for their preparation, and lubricating oils containing such additives.

BACKGROUND OF THE INVENTION

Because of spiralling energy costs over recent years, much consideration has been given to means of reducing metal-to-metal friction in various mechanical devices where oil or grease lubrication is employed. The goal is to reduce energy consumption by lowering coefficients of friction between moving parts. To achieve lowered friction, the use of lubricants containing very finely divided polytetrafluoroethylene (PTFE) polymers, which are known to provide unusually low coefficients of friction, has been proposed. The rationale is that the dispersed polymer will form a film on moving metal surfaces under conditions of both boundry and hydrodynamic lubrication, thereby reducing frictional losses.

Reick U.S. Pat. No. 4,127,491 has described for the above purpose an oil dispersion of a relatively high molecular weight, fluorocarbon resin, which is prepared from a colloidal aqueous dispersion of the resin, using a variety of additives as neutralizing agents, wetting agents and dispersants. The dispersions used contain water which complicates the production process. Moreover, the presence of water is undesirable under operating conditions.

Lewis U.S. Pat. No. 3,234,758 has described a uniform dispersion of powdered PTFE in a hydrocarbon base lubricating grease. These dispersions are not stabilized against PTFE sedimentation, and they are adversely affected by high shear forces. Reick U.S. Pat. No. 3,933,656 describes a PTFE dispersion which is stabilized to prevent PTFE agglomeration but not sedimentation. Reick U.S. Pat. No. 3,879,302 describes an aqueous PTFE dispersion which suffers at high rates of shear and suffers from PTFE sedimentation. Similarly, the aqueous dispersions described in Reick's U.S. Pat. Nos. 4,224,173, 4,284,519, 4,284,518 and 3,194,762 are not stabilized to prevent PTFE sedimentation, and their performance under high shear forces suffers.

It would be advantageous from a cost standpoint, a major consideration in the use of this type of additive, to avoid the use of an aqueous dispersion of the fluorocarbon as a starting material, since this unduly complicates the manufacturing process. It would also be desirable to employ a single dispersant rather than the combination of neutralizing agents, wetting agents and dispersants which are conventionally present in aqueous dispersions. Furthermore, it would be desirable to obtain a dispersion which is not adversely affected by high rates of shear. It is especially important to have a dispersion which shows essentially no sedimentation of PTFE after long periods of ambient storage, since sedimented polymer is difficult to redisperse.

SUMMARY OF THE INVENTION

The present invention overcomes the foregoing deficiencies of the prior art by providing non-aqueous additive compositions for lubricating oils. The additives contemplated herein contain polytetrafluoroethylene (PTFE) particles and show no sedimentation of the PTFE after long periods of storage and are unaffected by high shear rates. Briefly, the present invention provides oil additive compositions comprising finely divided polytetrafluoroethylene powders, organo-clay anti-sedimentation additives, a polar additive, and oil-soluble, nitrogen-containing polymeric dispersants. The invention further contemplates methods for the preparation of the oil dispersion additives and lubricants containing such additives.

The dispersions of the present invention are made by admixing suitable amounts of a base oil, particulate polytetrafluoroethylene, a nitrogen-containing polymeric dispersant, an organo-clay, and an oil-miscible polar activator for the clay at moderate temperatures (30°–50° C., for example). In the present invention the use of high-speed, high-shear mixing is preferred, in contrast to processes of the prior art, where this manner of mixing is specifically proscribed as conducive to agglomeration of the fluorocarbon. Dispersions of the present invention are superior to those of the prior art for lubricating machines in which high speeds and high shear are encountered.

The present invention is an improvement over the prior art in the following significant respects:

(a) Use of a very finely powdered PTFE instead of an aqueous dispersion of PTFE.

(b) Use of an oil-miscible polymeric dispersant which contains nitrogen.

(c) Use of an organo-clay anti-sedimentation additive.

(d) Use of high-speed, high-shear mixing in the manufacturing process.

DETAILED DESCRIPTION OF THE INVENTION

The particulate polytetrafluoroethylene desirably has a molecular weight of from 500,000 to about 2,000,000. The particle size is desirably from about 0.1 to four microns mean diameter. Smaller particle sizes are unavailable, and too large a particle size tends to increase sedimentation. PTFE having a particle size of from 0.2 to 0.5 microns is preferred in certain embodiments of this invention.

A satisfactory starting material, as supplied by ICI Americas as Whitcon 8, has the following properties:

| | |
|---|---|
| Specific gravity | 2.15–2.25 |
| Bulk density | 530 g/L |
| Primary particle size | 0.2–0.3 microns |
| Powder agglomerate size range | 5–50 microns |
| Typical coefficient of friction | 0.06–0.08 |
| Molecular weight | About 800,000 |

The oil component is a lubricating oil. It can be a mineral oil or a synthetic oil (i.e., an ester or a polyolefin). It is preferred in practicing this invention to utilize a solvent neutral mineral oil having a kinematic viscosity, at 40° C., of 40–70 cs., preferably 50–60, and a viscosity index of 90–95.

The dispersants utilized herein are polymers containing approximately 0.2% nitrogen and are supplied as a concentrate in mineral oil containing 30% polymer by weight. In particular, Acryloid 953, a polymethacrylate copolymer, as provided by Rohm and Haas, having an average molecular weight of from about 50,000 to about 1,000,000 and containing nitrogen from the inclusion of dialkylaminoalkyl methacrylate, is effective as a dispersant for the purpose of the present invention. The inclusion of dimethylaminomethyl methacrylate in a methacrylate polymer having a molecular weight of from 200,000 to about 500,000 is a particularly effective embodiment of the invention.

It is a preferred embodiment of this invention to utilize Amoco 6565, an ethylene-propylene copolymer dispersant provided by Amoco Chemicals, having an average molecular weight of from about 20,000 to about 50,000 and containing nitrogen from a reaction with an amine. Nitrogen-containing ethylene-propylene copolymers having an average molecular weight of from 10,000 to about 200,000 are effective dispersants in this invention.

Unexpectedly, some other dispersants which, like the two disclosed above, have been used effectively as dispersants in crankcase lubricants, are not operable for the purpose of the present invention, since they do not provide stable dispersions of PTFE. For example, a widely used alkenyl succinimide, derived from 1,200 M.W. polybutene, is ineffective for preparing the dispersions of this invention.

The organo-clay sedimentation inhibitors of this invention are selected from those marketed by NL Chemicals/NL Industries, Inc., Hightstown, N.J., under the trade name Bentone. The two preferred products are Bentone 34 (tetraalkyl ammonium bentonite) and Bentone 38 (tetraalkyl ammonium hectorite). While Bentone 34 is satisfactory for the purpose of the present invention, the use of Bentone 38 yields optimum results in certain embodiments. The tetraalkyl ammonium clays may retard sedimentation in the dispersions of this invention by setting up a supporting gel structure.

A polar additive is used to insure the maximum effectiveness of the organo-clay component. A polar additive provided by Rohm and Haas and found to be very satisfactory in the additives of this invention is Triton N-42, an ethoxylated nonylphenol containing about four ethoxy groups per molecule. Many other ethoxylated derivatives of alkylphenols, alcohols and amines, for example, can be used as long as they are miscible with the carrier oil. The polar additive is effective to deagglomerate the organo-clay component.

BLENDED OIL ADDITIVE OF PTFE

It is desirable for the additive to contain, by weight, from about 0.5 to about ten % PTFE, three to about fifteen % dispersant (0.9 to about 4.5% 100% polymer), from 0.8 to about 1.5% organo-clay, from 1.5 to about two % polar additive, with the remainder being mineral oil.

DETERMINING STORAGE STABILITY OF DISPERSIONS

A very significant test of the ability of additives of the present invention to resist sedimentation is to allow 200 to 300 ml of the additive to stand in 500 ml glass containers at ambient temperature (25°-30° C.) with periodic visual examination to determine the presence and extent of separated PTFE. Since the additives of this invention are frequently diluted by as much as 20 to 1 with oil for certain lubrication uses, it is also important to apply the same periodic visual examination to stored samples of a given dispersion after dilution with 20 parts of base oil.

MANUFACTURING PROCEDURE

The procedure generally followed in carrying out this invention comprises first weighing the appropriate amount of oil, dispersant and polar additive into the mixer and stirring at low speed (about 5,000 RPM) until homogeneous. The appropriate amount of organo-clay is then added, and stirring is continued at low speed for approximately 1-5 minutes, depending on the size of the mixer. Finally, the desired amount of PTFE is added and stirring is continued at the highest speed (about 20,000 RPM in the case of a small blender) and at high shear for 5-10 minutes, depending on the size of the mixer and the quantity of material. This completes the manufacturing procedure.

UTILIZATION OF DISPERSIONS OF INVENTION

The additives of this invention are employed as concentrates to be diluted with mineral or synthetic oils for a particular lubrication application, notwithstanding that they may be used in special situations without dilution. Ratios of 1 to 20, as high as 1 to 100, or as low as 1 to 5 can be employed. The concentrates may also be used in lubricating greases in similar dilution ratios.

No restrictions on the type of machines in which the dispersions of this invention can be used is contemplated, except that their use is contraindicated wherever they may come in contact with clutching devices, as in automatic transmissions, for example.

For many uses the dispersions of this invention may be diluted with oils containing no other additives. However, they can also be diluted with oils into which other additives have been incorporated for special applications. For example, many crankcase lubricants contain, inter alia, detergents, corrosion inhibitors, and oxidation inhibitors. The dispersions of this invention can be used with such additive-containing oils except where incompatibility, as evidenced by formation of sediment or precipitates in the blended products, is observed.

The following examples are given to illustrate embodiments of the invention as it is presently preferred to practice it. Sedimentation test results are illustrated in Table I. Unless otherwise indicated, all ratios, percentages, parts and proportions herein are by weight. It will be understood that these examples are illustrative, and the invention is not to be considered as restricted thereto except as indicated in the appended Claims.

EXAMPLE 1

Two hundred grams of mineral oil, twenty grams of Amoco 6565, an ethylene-propylene copolymer containing nitrogen, and four grams Triton N-42, an ethoxylated nonylphenol, are weighed into a Waring blender and stirred at low speed for one minute. To this blend is added 2.5 grams Bentone 38, a tetraalkyl ammonium hectorite, while stirring at low speed for about one minute. Then four grams Whitcon 8 (PTFE) are added and the blend is mixed at the highest speed (15,000-20,000 RPM) for five minutes.

After standing nine days at room temperature, there is a trace of PTFE sedimentation in the additive and trace-to-light PTFE sedimentation in the 1:20 dilution. After ten months there is still only a trace of sedimentation in the additive and trace-to-light sedimentation in the 1:20 dilution.

EXAMPLE 2

Same procedure as heretofore described in Example 1, except 12.5 grams of Acryloid 953, a methacrylate ester-dimethylaminomethyl methacrylate copolymer, is substituted for the twenty grams of Amoco 6565.

EXAMPLE 3

Same procedure as heretofore described in Example 1, except Amoco 6565 is omitted from the dispersion.

EXAMPLE 4

Same procedure as heretofore described in Example 1, except Bentone 38 is omitted from the dispersion.

EXAMPLE 5

Same procedure as heretofore described in Example 1, except the amount of Triton N-42 utilized is reduced from four grams to three grams.

EXAMPLE 6

Same procedure as heretofore described in Example 1, except four grams of DuPont DLX-6000 (polytetrafluoroethylene) are substituted for the four grams of Whitcon 8.

EXAMPLE 7

Same procedure as heretofore described in Example 1, except the amount of Amoco 6565, Bentone 38 and Whitcon 8 utilized is increased to forty grams, four grams and 27 grams respectively.

EXAMPLE 8

Same procedure as heretofore described in Example 1, except the components of the dispersion are added in the following order: Oil, Amoco 6565, Bentone 38, Triton N-42 and Whitcon 8.

EXAMPLE 9

Same procedure as heretofore described in Example 1, except the components of the dispersion are added in the following order: Oil, Amoco 6565, Whitcon 8, Bentone 38 and Triton N-42.

EXAMPLE 10

Same procedure as heretofore described in Example 1, except 2.5 grams of Bentone 34 (tetraalkyl ammonium bentonite) are substituted for the 2.5 grams of Bentone 38.

EXAMPLE 11

Same procedure as heretofore described in Example 1, except Triton N-42 is omitted from the dispersion.

EXAMPLE 12

Same procedure as heretofore described in Example 1, except 2,600 grams of oil, 261 grams of Amoco 6565, 52 grams of Triton N-42, 42 grams of Bentone 38 and 52 grams of Whitcon 8 are blended to form the dispersion additive.

EXAMPLE 13

A pure mineral lubricating oil having a viscosity at 100° F. of 300 SSU is blended with 10% by weight of the additive prepared in Example 1, and the resulting blend is used to lubricate a Wardwell 16 carrier braider set up for wire shielding. The following advantages over the use of the mineral oil alone are observed:

(a) A 10% reduction in power consumption.

(b) Reduced frequency of lubrication from once per hour to once per eight hours.

(c) A reduction in noise level.

TABLE I

| | Ex. 1 | Ex. 2 | Ex. 3 |
|---|---|---|---|
| Composition (wt. %) | | | |
| Mineral Oil | 86.7 | 89.9 | 95.0 |
| Amoco 6565 | 8.8 | — | — |
| Acryloid 953 | — | 5.6 | — |
| Triton N-42 | 1.7 | 1.7 | 1.9 |
| Bentone 38 | 1.1 | 1.1 | 1.2 |
| Whitcon 8 | 1.7 | 1.7 | 1.9 |
| DuPont DLX-6000 | — | — | — |
| Bentone 34 | — | — | — |
| Appearance of Additive | | | |
| 1 day | No sed. | No sed.(1) | No sed. |
| 9 days | Tr. sed. | N/A | N/A |
| 2 mos. | N/A | N/A | N/A |
| 3 mos. | N/A | Tr. sed. | N/A |
| 10 mos. | Tr. sed. | N/A | ¼" clear oil on top |
| Appearance of 5% Additive Blend in Mineral Oil | | | |
| 1 day | Tr. sed. | Tr.-lt. sed. | Lt.-med. sed. |
| 9 days | Tr.-lt. sed. | N/A | N/A |
| 2 mos. | N/A | N/A | N/A |
| 10 mos. | Tr.-Lt. sed. | Lt.-med. sed. | N/A |

| | Ex. 4 | Ex. 5 | Ex. 6 |
|---|---|---|---|
| Composition (wt. %) | | | |
| Mineral Oil | 87.6 | 87.3 | 86.7 |
| Amoco 6565 | 8.8 | 8.7 | 8.8 |
| Acryloid 953 | — | — | — |
| Triton N-42 | 1.8 | 1.3 | 1.7 |
| Bentone 38 | — | 1.1 | 1.1 |
| Whitcon 8 | 1.8 | 1.6 | — |
| DuPont DLX-6000 | — | — | 1.7 |
| Bentone 34 | — | — | — |
| Appearance of Additive | | | |
| 1 day | ⅛" sed. | Tr. sed. | No sed. |
| 9 days | N/A | N/A | N/A |
| 2 mos. | N/A | N/A | No sed. |
| 3 mos. | N/A | N/A | N/A |
| 10 mos. | N/A | Lt. sed. | N/A |
| Appearance of 5% Additive Blend in Mineral Oil | | | |
| 1 day | N/A | Tr. sed. | N/A |
| 9 days | N/A | N/A | N/A |
| 2 mos. | N/A | N/A | Med.-hvy. sed. |
| 10 mos. | N/A | Lt. sed. | N/A |

| | Ex. 7 | Ex. 8 | Ex. 9 |
|---|---|---|---|
| Composition (wt. %) | | | |
| Mineral Oil | 72.7 | 86.7 | 86.7 |
| Amoco 6565 | 14.5 | 8.8 | 8.8 |
| Acryloid 953 | — | — | — |
| Triton N-42 | 1.5 | 1.7 | 1.7 |
| Bentone 38 | 1.5 | 1.1 | 1.1 |
| Whitcon 8 | 9.8 | 1.7 | 1.7 |
| DuPont DLX-6000 | — | — | — |
| Bentone 34 | — | — | — |
| Appearance of Additive | | | |
| 1 day | No sed. | No sed. | No sed. |
| 9 days | No sed. | No sed. | No sed. |
| 2 mos. | No sed. | No sed. | No sed. |
| 3 mos. | N/A | No sed. | No sed. |
| 10 mos. | N/A | N/A | N/A |
| Appearance of 5% Additive Blend in Mineral Oil | | | |
| 1 day | Lt. sed. | Tr. sed. | Tr. sed. |
| 9 days | N/A | Tr.-lt. | Tr.-lt. |

TABLE I-continued

| | | | |
|---|---|---|---|
| | | sed. | sed. |
| 2 mos. | N/A | N/A | N/A |
| 10 mos. | N/A | N/A | N/A |
| | Ex. 10 | Ex. 11 | Ex. 12 |
| Composition (wt. %) | | | |
| Mineral Oil | 86.7 | 88.3 | 86.5 |
| Amoco 6565 | 8.8 | 8.8 | 8.7 |
| Acryloid 953 | — | — | — |
| Triton N-42 | 1.7 | — | 1.7 |
| Bentone 38 | — | 1.1 | 1.4 |
| Whitcon 8 | 1.7 | 1.8 | 1.7 |
| DuPont DLX-6000 | — | — | — |
| Bentone 34 | 1.1 | — | — |
| Appearance of Additive | | | |
| 1 day | Tr. sed. | ⅛" sed. (med.) | No sed. |
| 3 days | N/A | ⅜" sed. (med.-hvy.) | No sed. |
| 9 days | Lt.-med. sed. | N/A | N/A |
| 2 mos. | N/A | N/A | N/A |
| 3 mos. | N/A | N/A | N/A |
| 10 mos. | N/A | N/A | N/A |
| Appearance of 5% Additive Blend in Mineral Oil | | | |
| 1 day | Tr.-lt. sed. | Tr. sed. | No sed. |
| 3 days | N/A | Tr.-lt. sed. | No sed. |
| 9 days | Tr.-lt. sed. | N/A | N/A |
| 2 mos. | N/A | N/A | N/A |
| 10 mos. | N/A | N/A | N/A |

(1)Much more viscous than the product from Example 1.
N/A = Not analyzed.

What is claimed is:

1. A concentrated non-aqueous lubricant additive having excellent resistance to sedimentation, said additive comprising in parts by weight, a mixture of:

(a) about 0.5% to about 10% particulate polytetrafluoroethylene having a particle size in the range from about 0.1 microns to about 4 microns;

(b) about 3% to about 15% of a nitrogen-containing polymeric dispersing agent effective to disperse the polytetrafluoroethylene;

(c) about 0.5% to about 2% of an organo-clay anti-sedimentation agent effective to prevent polytetrafluoroethylene sedimentation;

(d) about 1% to about 2.5% of an oil-miscible polar additive to deagglomerate said organo-clay; and (e) a lubricating carrier oil.

2. An additive as set forth in claim 1, wherein said polytetrafluoroethylene particles have a molecular weight in the range of about 500,000 to 2,000,000.

3. An additive as set forth in claim 1, wherein said particles have a particle size in the range of about 0.2 to 0.5 microns.

4. An additive as set forth in claim 1, wherein said organo-clay is a tetraalkyl ammonium clay.

5. An additive as set forth in claim 4, wherein said organo-clay is tetraalkyl ammonium hectorite.

6. An additive as set forth in claim 4, wherein said organo-clay is tetraalkyl ammonium bentonite.

7. An additive as set forth in claim 1, wherein said dispersing agent contains about 0.2% nitrogen.

8. An additive as set forth in claim 7, wherein said dispersing agent is a methacrylate ester-dialkylaminoalkyl methacrylate copolymer.

9. An additive as set forth in claim 7, wherein said dispersing agent is a methacrylate ester-dimethylaminomethyl methacrylate copolymer.

10. An additive as set forth in claim 7, wherein said dispersing agent is an ethylene-propylene copolymer.

11. An additive as set forth in claim 1, wherein said polar additive is an ethoxylated alkylphenol having about four ethoxy groups per molecule.

12. An additive as set forth in claim 11, wherein said polar additive is an ethoxylated nonylphenol.

13. An additive as set forth in claim 1, wherein said carrier oil is a mineral oil.

14. An additive as set forth in claim 13, wherein said mineral oil has a kinematic viscosity, at 40° C., of 50–60 cs. and a viscosity index of 90–95.

15. An additive as set forth in claim 1, wherein said carrier oil is a synthetic oil.

16. A lubricant composition comprising the additive as set forth in claim 1, in an amount effective to reduce friction; and a lubricating substance selected from the group consisting of lubricating oils and greases, the weight ratio of said additive to said lubricating substance ranging from about 1:1 to 1:100.

17. An additive as set forth in claim 1, which comprises, by weight, about 0.8 to 1.5% organo-clay, about 1.5 to 2.0% polar additive, about three to 15% dispersing agent, about 0.5 to 10% polytetrafluoroethylene, the remainder being mineral oil.

18. An additive as set forth in claim 17, wherein the polytetrafluoroethylene particles comprise about one to two %, by weight, of the total additive.

19. An additive as set forth in claim 17, wherein the dispersing agent comprises about 5 to 10%, by weight, of the total additive.

20. A method of preparing a non-aqueous lubricant additive having excellent resistance to sedimentation, comprising the steps of:

(a) preparing a mixture of carrier oil, about 3% to about 15% by weight of said additive of a nitrogen-containing polymeric dispersing agent and about 1% to about 2.5% by weight of said additive of an oil-miscible polar additive;

(b) adding to the mixture about 0.5% to about 2% by weight of the first-mentioned said additive of an organo-clay anti-sedimentation agent and about 0.5% to about 10% by weight of the first mentioned said additive of a non-aqueous particulate polytetrafluoroethylene having a particle size in the range from about 0.1 microns to about 4 microns to form a dispersion;

(c) subjecting the dispersion to high shear forces.

21. A method as set forth in claim 20, wherein the high shear mixing is conducted in a blender with a rotating shearing blade rotating at a speed of about 20,000 RPM.

22. A concentrated non-aqueous lubricant additive having excellent resistance to sedimentation, said additive comprising, in parts by weight, a mixture of:

(a) about 0.5% to about 10% of particulate polytetrafluoroethylene having a particle size in the range from about 0.1 micron to about 4 microns;

(b) about 3% to about 15% of a nitrogen-containing polymeric dispersing agent effective to disperse the polytetrafluoroethylene and selected from methacrylate ester-dialkylaminoalkyl methacrylate copolymer, methacrylate ester-dimenthylaminoethyl methacrylate copolymer, ethylene-propylene copolymer and mixtures thereof;

(c) about 0.5% to about 2% of a tetraalkyl ammonium clay antisedimentation agent effective to prevent polytetrafluoroethylene sedimentation;

(d) about 1% to about 2.5% ofan oil-miscible polar additive to deglomerate said clay and which is an ethoxylated alkylphenol having about four ethoxy groups per molecule; and (e) the balance essentially a lubricating carrier oil.

23. A lubricant composition comprising the additive as set forth in claim 22, in an amount effective to reduce friction; and a lubricating substance selected from the group consisting of lubricating oils and greases; the weight ratio of said additive to said lubricating substance ranging from about 1:1 to 1:100.

* * * * *

UNITED STATES PATENT AND TRADEMARK OFFICE

CERTIFICATE OF CORRECTION

PATENT NO. : 4,615,817

DATED : October 7, 1986

INVENTOR(S) : Frederic C. McCoy

It is certified that error appears in the above-identified patent and that said Letters Patent is hereby corrected as shown below:

Col. 8, line 44, cancel "the first-mentioned"; after "said" insert --non-aqueous lubricant--;

lines 46 and 47, cancel "the first-mentioned"; line 47, after "said" insert --non-aqueous lubricant--.

Signed and Sealed this

Thirteenth Day of January, 1987

*Attest:*

DONALD J. QUIGG

*Attesting Officer*

*Commissioner of Patents and Trademarks*